US007438211B2

(12) United States Patent
Tseng

(10) Patent No.: US 7,438,211 B2
(45) Date of Patent: Oct. 21, 2008

(54) PAPER CONTAINER AND PAPER EXHIBITION BOX CONTAINING THE PAPER CONTAINERS

(75) Inventor: Tseng-Hung Tseng, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 649 days.

(21) Appl. No.: 11/046,837

(22) Filed: Feb. 1, 2005

(65) Prior Publication Data

US 2006/0169754 A1 Aug. 3, 2006

(51) Int. Cl.
*B65D 5/00* (2006.01)
*B65D 25/54* (2006.01)

(52) U.S. Cl. ..... 229/112; 229/115; 229/162.1

(58) Field of Classification Search ..... 229/108, 229/112, 115, 162.1, 235; 206/436, 771, 206/738, 769; 220/23.86, 23.83, 23.87
See application file for complete search history.

(56) References Cited

U.S. PATENT DOCUMENTS 1,125,175 A * 1/1915 Rey ..... 206/242
2,003,600 A * 6/1935 Lowenfels ..... 426/130
6,135,289 A * 10/2000 Miller ..... 206/774

* cited by examiner

*Primary Examiner*—Nathan J Newhouse
*Assistant Examiner*—Christopher Demeree
(74) *Attorney, Agent, or Firm*—Bacon & Thomas, PLLC

(57) ABSTRACT

The present invention is to provide a paper container comprising an inner case and an outer case, wherein the inner case comprises upper and lower trapezoidal blocks and a connecting member formed between three edges of the upper and lower trapezoidal blocks to define a receiving space for storing at least one object. The upright outer case is of triangular section and comprises an internal space for receiving the inner case and a window facing the receiving space to allow viewing of the at least one object.

6 Claims, 5 Drawing Sheets

PAPER CONTAINER AND PAPER EXHIBITION BOX CONTAINING THE PAPER CONTAINERS

FIELD OF THE INVENTION

The present invention relates to paper containers and more particularly to a paper container and a paper exhibition box containing a plurality of such paper containers with improved characteristics.

BACKGROUND OF THE INVENTION

Solid waste is mainly contributed by discarded things, garbage, etc. Amount of solid waste is proportional to the wealth of a country. Waste is required to properly dispose. Otherwise, environment will be polluted. Nowadays, plastic products are widely used in our daily life due to its advantageous features such as lightweight, cheap, etc. The popularity of plastic products, however, causes a serious problem of how to properly dispose garbage. Unfortunately, such problem has not been solved successfully, resulting in a serious environmental disaster in its extreme cases.

Plastics are composed of polymer molecules and various additives extracted from petroleum. One type of plastics such as polyvinyl chloride is toxic. Both air and water may be seriously polluted during the manufacturing process. For a food container made of plastics, toxic components thereof may be released to mix with food contained therein. Also, additives of a plastic product may release in a high temperature environment to cause dizziness or even liver cancer to nearby people.

Some plastic products are discarded by people after one use, resulting in a sharp increase of the amount of garbage. Garbage contributed by discarded plastic products is not biodegradable. Typically, it is sent to incinerator for burning to ashes. However, incineration may cause air pollution. Moreover, sewers may be blocked by such waste. To the worse, flood may occur when torrential rain falls if the blockage is not removed.

The best way to solve the garbage problem caused by discarded plastic products is to reject the use of plastic products. As such, the best way to solve the problem of air pollution is to use paper products as replacement of plastic products. However, some types of paper box (e.g., paper container) are too complicated in structure to be shipped easily. Also, its unsymmetrical shape may waste much precious space, resulting in an increase of the shipping cost. Moreover, it may bother the staffs of a shopping center how to appropriately arrange products contained by such paper containers. Visually unattractive paper containers placed in a store can lower the buying desire of consumers. In addition, the prior paper containers are structurally weak, resulting in the failure of protecting the integrity and maintaining the intactness of products as well as the increase of unnecessary arranging cost. The most undesirable thing may be the unwillingness of accepting such paper containers by stores. This in turn may thwart the growth of paper container industry.

Thus, it is desirable among the industry to provide a novel paper container having advantages of easy assembly and shipping, facilitating exhibition in a store, highly resistive to impact, protection of products contained therein, safely storing products contained therein, easily accepted by consumers, and being highly competitive in order to overcome the inadequacies of the prior art.

SUMMARY OF THE INVENTION

After considerable research and experimentation, a paper container and a paper exhibition box containing the paper containers according to the present invention have been devised so as to overcome the above drawbacks of the prior art.

It is an object of the present invention to provide a paper container comprising an inner case and an outer case. The inner case comprises upper and lower trapezoidal blocks and a connecting member formed between three edges of the upper and lower trapezoidal blocks to define a receiving space for storing at least one object. The upright outer case is of triangular section and comprises an internal space for receiving the inner case and a window facing the receiving space to allow viewing of the at least one object.

It is another object of the present invention to provide a paper exhibition box for containing a plurality of paper containers for facilitating shipping and protecting products contained in the paper containers. The paper exhibition box comprises a tear line formed across a plurality of its continuous faces, a tear section, and a storage section wherein the tear section and the storage section are formed at both sides of the tear line such that tearing off the tear section will cause the storage section to allow viewing the paper containers.

The above and other objects, features and advantages of the present invention will become apparent from the following detailed description taken with the accompanying drawings.

DETAILED DESCRIPTION OF THE PREFERRED EMBODIMENTS

Figure 1:
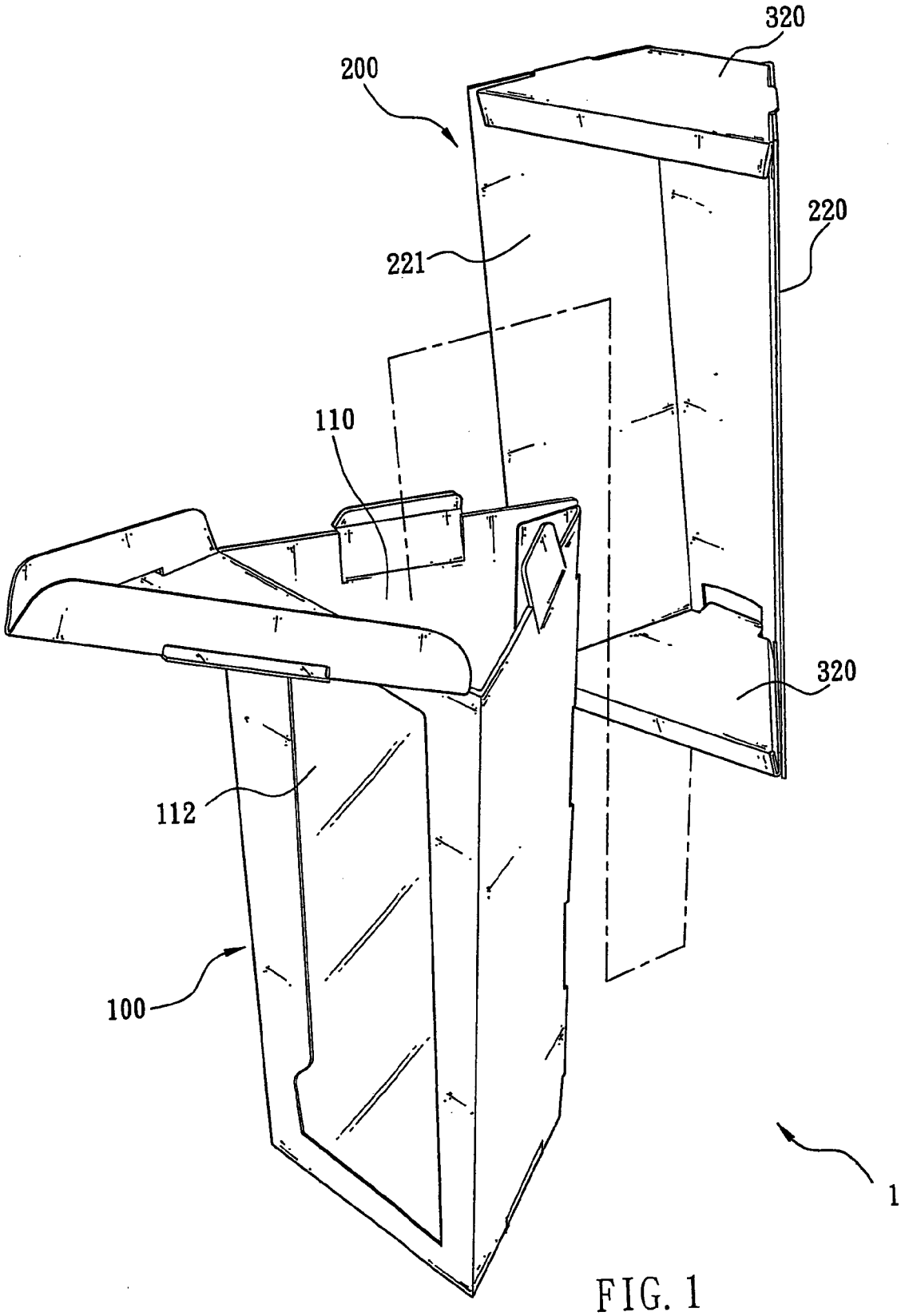
FIG. 1 is an exploded view of a preferred embodiment of paper container according to the invention.

Referring to FIG. 1, a paper container according to a preferred embodiment of the invention is shown. The paper container comprises an outer case 100 and an inner case 200. The inner case 200 comprises two trapezoidal blocks 320 and a connecting member 220. The connecting member 220 is formed between three edges of the upper and lower trapezoidal blocks 320 to define a receiving space 221 for storing at least one object. The outer case 100 is an upright member of triangular section and has a space 110 for receiving the inner case 200. The outer case 100 comprises a window 112 to allow viewing of the object.

Figure 2:
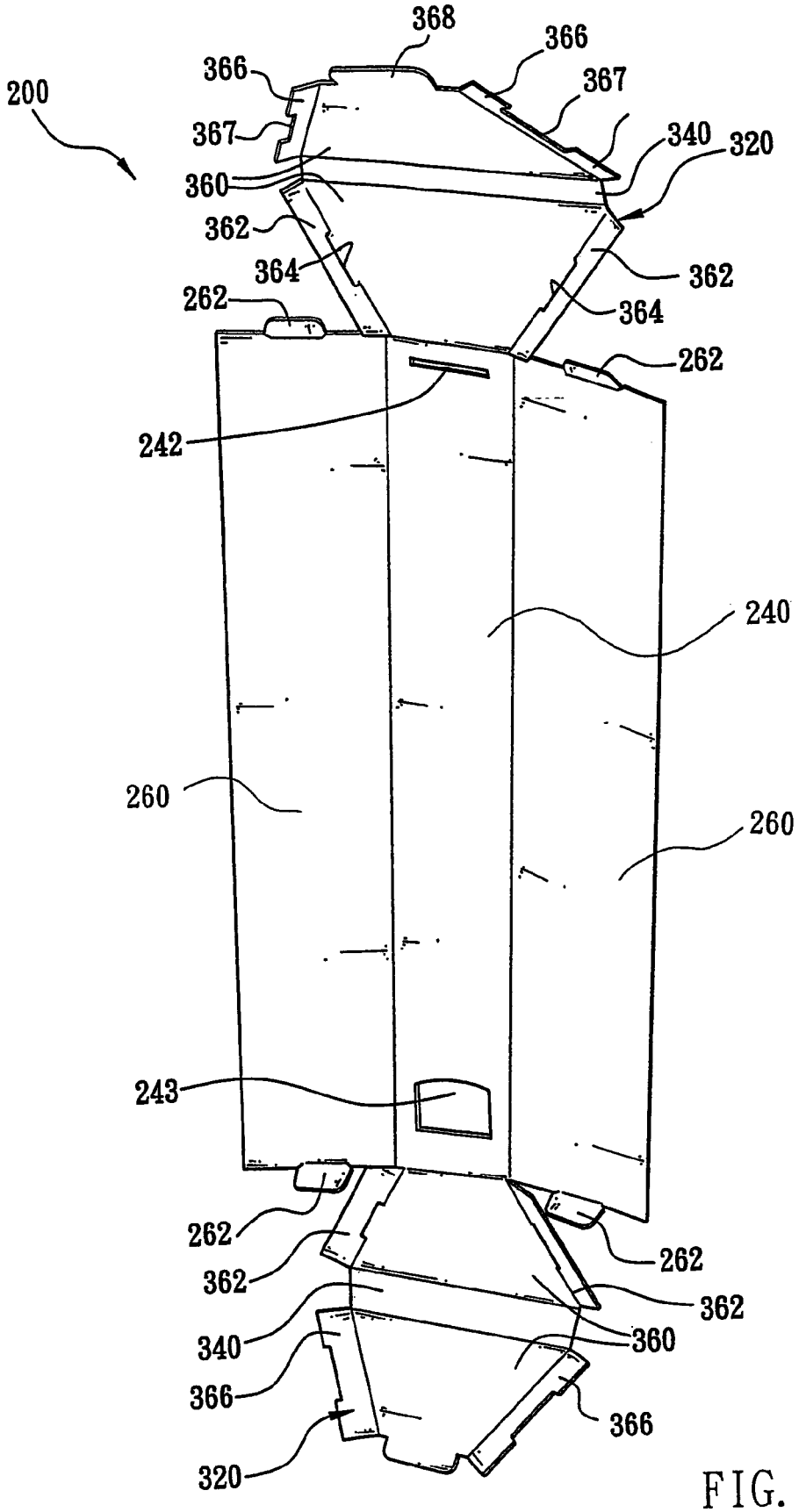
FIG. 2 is an extended view of the inner case of FIG. 1.

Referring to FIG. 2, the inner case 200 according to the preferred embodiment of the invention is shown. Either trapezoidal block 320 comprises two trapezoidal surfaces 360 and a connecting face 340. The connecting face 340 is a rectangle and has two elongate edges connected to two elongate edges of the trapezoidal blocks 320 respectively. One trapezoidal surface 360 is interconnected the connecting member 220 and the connecting face 340 in which a short edge of the trapezoidal surface 360 is connected to the connecting member 220 and a projected first lip 362 is formed along either side edge of the trapezoidal surface 360. A first cut 364 is formed in an intermediate portion of the first lip 362 abutted a folded line between the first lip 362 and the trapezoidal surface 360. Likewise, a projected tab 366 is formed along either edge of the other trapezoidal surface 360. A recess 367 is formed in an intermediate portion of the tab 366 opposing a corresponding edge of one trapezoidal surface 360. A second ear 368 is formed at one edge of the other trapezoidal surface 360 opposing the connecting face 340. Either first lip 362 of one trapezoidal surface 360 is adapted to matingly engage with either adjacent tab 366 of the other trapezoidal surface 360. As a result, both trapezoidal blocks 320 are formed each having the connecting face 340 as one connecting side and the trapezoidal surfaces 360 as two facing surfaces.

Also, the upright connecting member 220 comprises an intermediate face 240 and two side faces 260 each connected to either elongate edge of the intermediate face 240. Top and bottom first ears 262 are projected from both short edges of either side face 260 respectively. The first ear 262 is shaped to matingly engage with the corresponding recess 367. A second cut 242 is formed proximate a top of the intermediate face 240. The second cut 242 is shaped to allow the second ear 368 of the other trapezoidal surface 360 to insert thereinto. Both side faces 260 are adapted to fold toward the trapezoidal blocks 320 to insert the first ears 262 of both side faces 260 into the first cuts 364. As a result, the inner case 200 is formed and the inner case 200 is thus highly resistive to impact for the protection of object(s) contained therein.

In the above embodiment, an opening 243 is formed proximate a bottom of the intermediate face 240. The opening 243 is larger than the second cut 242 for disposing of a portion of the stored object or allowing a component (e.g, power cord) thereof to pass.

Figure 3:
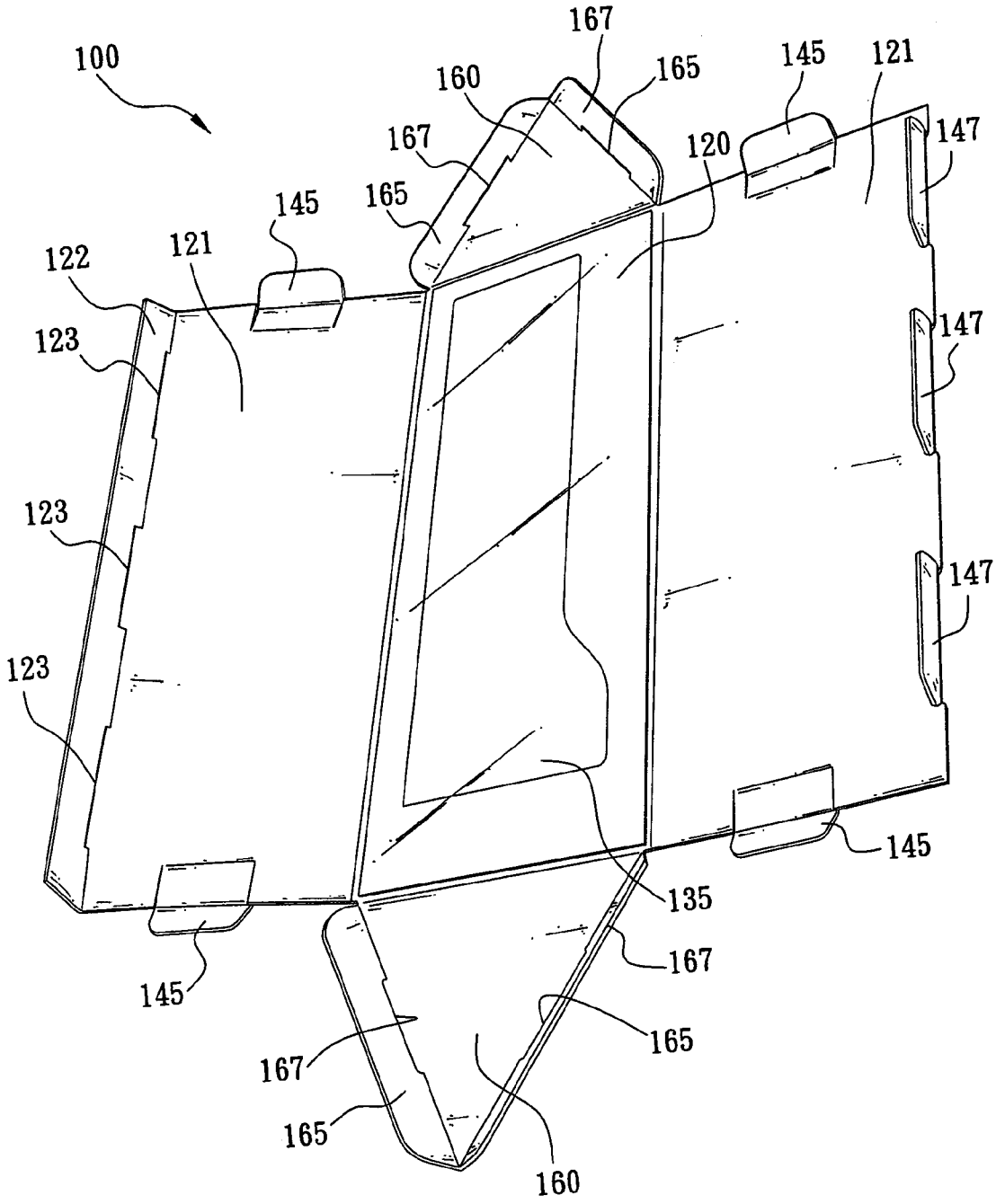
FIG. 3 is an extended view of the outer case of FIG. 1.

Referring to FIG. 3, in the above embodiment the outer case 100 is an integral member and comprises a main face 120, two side faces 121, and two cover faces 160. Each of the main face 120 and the side faces 121 is a rectangle and both elongate edges of the main face 120 are connected to that of the side faces 121 respectively. Top and bottom third ears 145 are projected from both short edges of either side face 121 respectively. A plurality of fourth ears 147 are provided along an elongate edge of one side face 121. A side extension 122 is provided at an elongate edge of the other side face 121. A plurality of third cuts 123 are provided between the side extension 122 and the other side face 121. The fourth ears 147 are adapted to insert into the third cuts 123 when the side faces 121 are connected together. The window 112 of the main face 120 is covered by a transparent surface (e.g., one formed of clear plastic). Each of two short edges of the main face 120 is connected to one edge of either cover face 160. Each of two side edges of either cover face 160 is provided with a second lip 165. A fourth cut 167 is formed between a folded line between the second lip 165 and the cover face 160. The third ears 145 are adapted to insert into the fourth cuts 167. As a result, the outer case 100 is formed.

For attaching two side faces 121 together, all ears must be aligned with all corresponding cuts prior to securely inserting the ears into the cuts. However, it may cause inconvenience in assembling the outer case 100. Fortunately, this can be successfully solved by the embodiment of the invention by referring to FIG. 3 again. A line is extended from one edge of the side face 121 across the edge of the third ear 145. Such lines can facilitate the third ears 145 pivoting rearward and thus facilitate the insertion of the third ears 145 into the fourth cuts 167. As a result, more space is saved for securely inserting the third ears 145 into the fourth cuts 167 and the inconvenience is thus eliminated.

Figure 4:
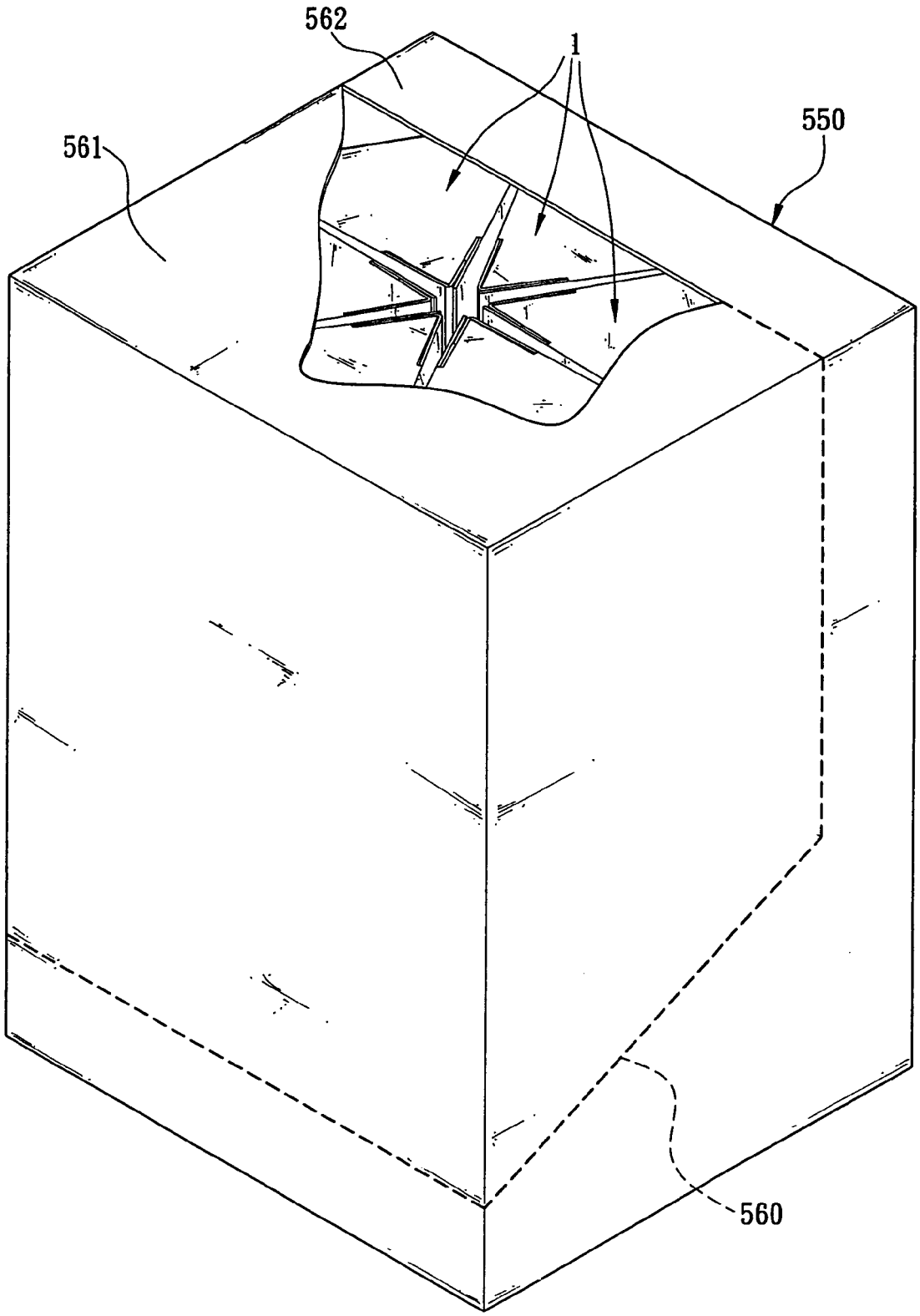
FIG. 4 schematically shows in perspective view a first preferred embodiment of paper exhibition box containing the paper containers according to the invention.

Referring to FIG. 4, a first preferred embodiment of paper exhibition box 550 containing the paper containers 1 according to the invention is shown. The paper exhibition box 550 containing a plurality of paper containers 1 can facilitate shipping and can protect the paper containers 1. A tear line 560 is formed across a plurality of continuous faces of the paper exhibition box 550. A tear section 561 and a storage section 562 are formed at both sides of the tear line 560. A user may tear off the tear section 561 to leave the storage section 562 for enabling customers to view the paper containers 1.

Referring to FIG. 1 again, in the preferred embodiment of the invention the paper container 1 comprises an inner case 200 and an outer case 100. The inner case 200 comprises two trapezoidal blocks 320 and an elongate, upright connecting member 220. The trapezoidal blocks 320 are formed at top and bottom of the connecting member 220 respectively. A receiving space 221 is formed and is open to one face of the connecting member 220. The receiving space 221 is adapted to store at least one object for viewing. The trapezoidal blocks 320 are adapted to withstand force exerted thereon for protecting the object(s). The outer case 100 is an upright member of triangular section and has a space 110 for receiving the inner case 200. The outer case 100 comprises a window 112 facing the receiving space 221 to allow viewing of the object(s).

Referring to FIG. 4 again, in the embodiment the tear section 561 is adapted to separate from the storage section 562 by tearing along the tear line 560. A person may view the paper containers 1 from a front side or either side of the separate tear section 561.

Figure 5:
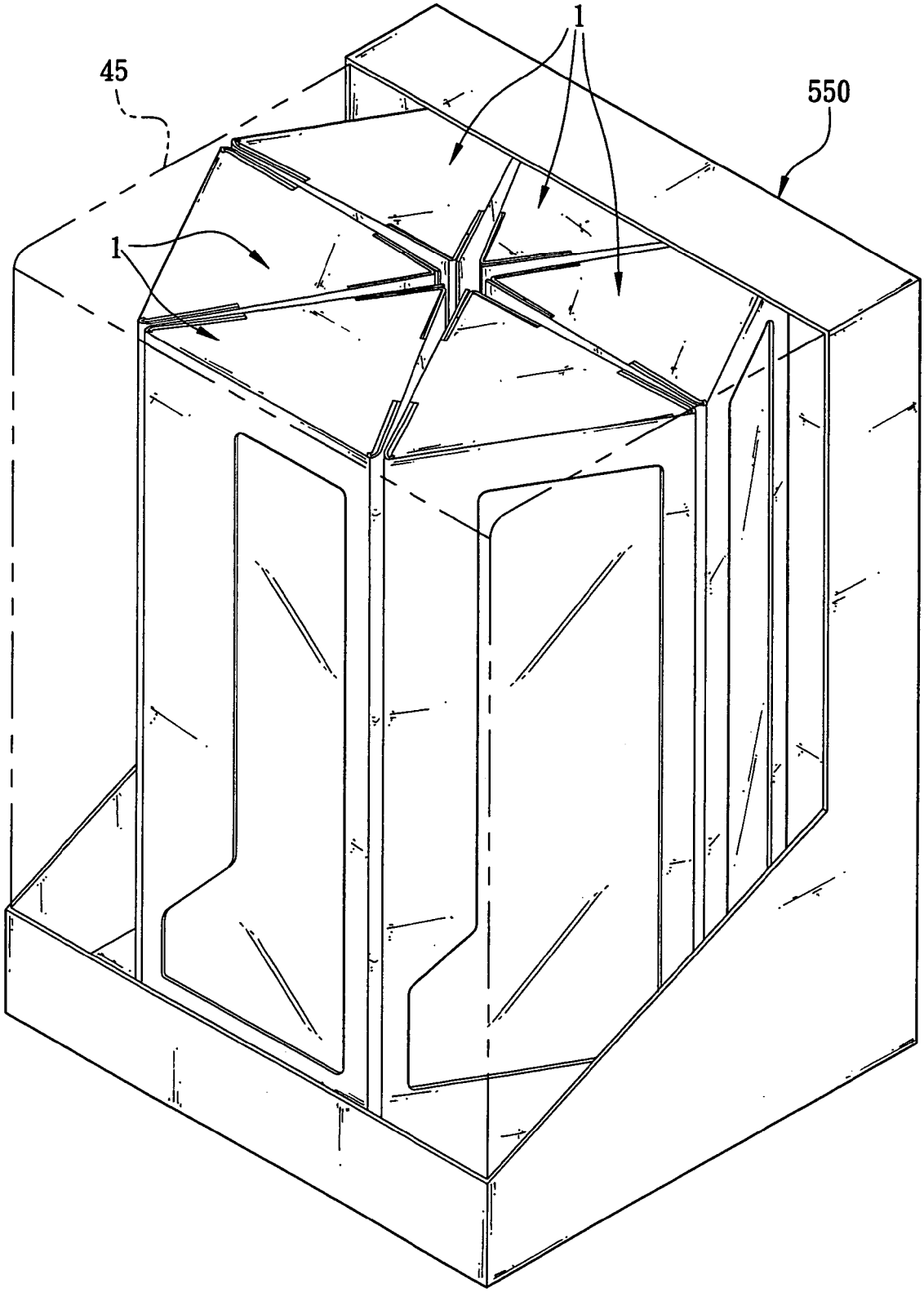
FIG. 5 schematically shows in perspective view a second preferred embodiment of paper exhibition box containing the paper containers according to the invention.

Referring to FIG. 5, a second preferred embodiment of paper exhibition box 550 containing the paper containers 1 according to the invention is shown. The second preferred embodiment will be illustrated in conjunction with FIG. 4. An opening of the storage section 562 is formed as a transparent cover 45 fitted in the paper exhibition box 550 for enabling a person to view the paper exhibition box 550 from its front side or either side. Thus, the paper exhibition box 550 has the advantages of saving exhibition space of a store or shopping center.

While the invention herein disclosed has been described by means of specific embodiments, numerous modifications and variations could be made thereto by those skilled in the art without departing from the scope and spirit of the invention set forth in the claims.

What is claimed is:

1. A paper container, comprising:

an inner case comprising upper and lower trapezoidal blocks and a connecting member formed between three edges of the upper and lower trapezoidal blocks to define a receiving space for storing at least one object;

wherein each trapezoidal block has a connecting face, two trapezoidal surfaces each having a respective elongate edge connected to that of the connecting face wherein one trapezoidal surface is disposed between the connecting member and the connecting face and has a short edge connected to the connecting member, and wherein one trapezoidal surface comprises a projected first lip formed along either side edge, a first cut formed in an intermediate portion of the first lip abutted a folded line between the first lip and one trapezoidal surface, and wherein the other trapezoidal surface comprises a projected tab formed along either edge, a recess formed in an intermediate portion of the tab opposing a corresponding edge of one trapezoidal surface, and a second ear formed at one edge opposing the connecting face, and wherein the first lips of one trapezoidal surface are adapted to matingly engage with corresponding tabs of the other trapezoidal surface for forming each of the trapezoidal blocks; and an upright outer case of triangular section and comprising an internal space for receiving the inner case and a window facing the receiving space to allow viewing of the at least one object.

2. The paper container of claim 1, wherein the connecting member comprises:

an intermediate face comprising two second cuts formed proximate a top and bottom thereof, the second cuts being shaped to allow the second ears of the other trapezoidal surfaces to insert thereinto, and two side faces each connected to either an elongate edge of the intermediate face and comprising top and bottom first ears projected from both short edges thereof respectively, wherein the first ears are shaped to matingly engage with the corresponding recesses, and the side faces are adapted to fold toward the trapezoidal blocks to insert the first ears of the side faces into the first cuts for forming the inner case.

3. The paper container of claim 2, wherein one second cut is an opening larger than the other second cut.

4. A paper container, comprising:

an inner case comprising upper and lower trapezoidal blocks and a connecting member formed between three edges of the upper and lower trapezoidal blocks to define a receiving space for storing at least one object; and an upright outer case of triangular section and comprising an internal space for receiving the inner case and a window facing the receiving space to allow viewing of the at least one object, wherein the outer case is formed integrally, and has a main face facing the receiving space and comprising a window thereon, two side faces each having either one of two elongate edges connected to that of the main face and comprising top and bottom third ears projected from two short edges respectively, wherein one side face comprises a plurality of fourth ears provided along the other elongate edge thereof, and wherein the other side face comprises a side extension provided at the other elongate edge thereof, the side extension including a plurality of third cuts provided between itself and the other side face, and wherein the fourth ears are adapted to insert into the third cuts when the side faces are connected together, and two cover faces each having one edge connected to either of two short edges of the main face, wherein either cover face comprises a second lip formed at each of its two side edges, and a fourth cut formed between a folded line between the second lip and itself, and wherein the third ears are adapted to insert into the fourth cuts for forming the outer case.

5. The paper container of claim 4, further comprising a line extended from one edge of either side face across the edge of the third ear such that the lines are adapted to facilitate the third ears pivoting rearward to insert into the fourth cuts.

6. The paper container of claim 4, further comprising a transparent surface on the window for covering.

* * * * *